US005286924A

United States Patent [19]

Loder et al.

[11] Patent Number: 5,286,924

[45] Date of Patent: Feb. 15, 1994

[54] MASS TERMINABLE CABLE

[75] Inventors: Harry A. Loder, Paradise, Calif.; Denis D. Springer, Austin, Tex.; John L. Roche, St. Paul, Minn.

[73] Assignee: Minnesota Mining and Manufacturing Company, St. Paul, Minn.

[21] Appl. No.: 949,457

[22] Filed: Sep. 22, 1992

Related U.S. Application Data

[63] Continuation-in-part of Ser. No. 766,580, Sep. 27, 1991.

[51] Int. Cl.[5] ..... H01B 7/08

[52] U.S. Cl. ..... 174/117 F; 156/52; 156/55; 174/110 PM; 174/110 F

[58] Field of Search ..... 174/117 F, 117 FF, 110 PM, 174/110 F; 156/52, 53, 55

[56] References Cited

U.S. PATENT DOCUMENTS

| | | | |
|---|---|---|---|
| 2,952,728 | 3/1956 | Yokose . | |
| 3,523,844 | 5/1964 | Crimmins et al. | 156/52 |
| 3,529,340 | 9/1970 | Polizzano et al. | 29/202.5 |
| 3,802,974 | 4/1974 | Emmel | 156/55 |
| 3,953,566 | 4/1976 | Gore | 264/288 |
| 4,187,390 | 2/1980 | Gore | 174/102 R |
| 4,218,581 | 8/1980 | Suzuki | 174/117 F |
| 4,375,379 | 3/1983 | Luetzow | 156/52 |
| 4,443,657 | 4/1984 | Hill et al. | 174/110 FC |
| 4,539,256 | 9/1985 | Shipman | 428/315.5 |
| 4,596,897 | 6/1986 | Gruhn | 174/36 |
| 4,640,569 | 2/1987 | Dola et al. | 439/461 |
| 4,642,480 | 2/1987 | Hughes et al. | 307/147 |
| 4,645,868 | 2/1987 | Suzuki | 174/117 F |
| 4,663,098 | 5/1987 | Gilliam et al. | 264/104 |
| 4,673,904 | 6/1987 | Landis | 333/238 |
| 4,680,423 | 7/1987 | Bennett et al. | 174/36 |
| 4,711,811 | 12/1987 | Randa | 428/383 |
| 4,716,073 | 12/1987 | Randa | 428/215 |
| 4,726,989 | 2/1988 | Mrozinski | 428/315.5 |
| 4,730,088 | 3/1988 | Suzuki | 174/102 |
| 4,988,835 | 1/1991 | Shah | 174/117 F |
| 5,030,794 | 7/1991 | Schell et al. | 174/36 |
| 5,110,998 | 5/1992 | Muschiatti | 174/24 |

FOREIGN PATENT DOCUMENTS

| | | | |
|---|---|---|---|
| 1256173 | 1/1986 | Canada | 337/66 |
| 0041097 | 2/1981 | European Pat. Off. . | |
| 0227268 | 1/1987 | European Pat. Off. . | |
| 0442346 | 2/1991 | European Pat. Off. . | |
| 3527846A1 | 2/1987 | Fed. Rep. of Germany . | |
| 9201301 | 1/1992 | PCT Int'l Appl. | 174/117 F |
| 9204719 | 3/1992 | PCT Int'l Appl. | 174/117 F |
| WO92/01301 | 7/1990 | World Int. Prop. O. . | |

OTHER PUBLICATIONS

Electronic Design, Sep. 28, 1989.
Connection Technology, pp. 27–29, Jun. 1991.
Item 1991, pp. 180–187.
Electronic Products, Oct. 1989.
Unlimited Design Possibilities, Feb. 1990.

*Primary Examiner*—Morris H. Nimmo
*Attorney, Agent, or Firm*—Gary L. Griswold; Walter N. Kirn; John C. Barnes

[57] ABSTRACT

A ribbon cable or discrete wires, having a layer of thermally stable, crush resistant, fibril microporous heat sealable thermoplastic crystallizable polymer dielectric surrounding said conductor. The thermoplastic dielectric having a void volume in excess of 70%, a propagation velocity of the insulated conductor greater than 85% the propagation velocity in air and the crush resistance being the recovery rate of the material after being under a 500 gram weight for 10 minutes greater than 92% of the initial thickness.

17 Claims, 5 Drawing Sheets

MASS TERMINABLE CABLE

RELATED CASE

This application is a continuation-in-part of application Ser. No. 07/766,580 filed Sep. 27, 1991.

BACKGROUND OF THE INVENTION

1. Field of the Invention

This invention relates to an improved electrical cable and process for making the subject cable having a low dielectric constant, and in particular, a flexible cable having one or more conductors having improved transmission line characteristics, improved crush resistance, and capable of mass termination.

2. Description of Prior Art

There already exists in the marketplace multiconductor flexible, mass terminable cables having transmission line characteristics such as controlled impedance, crosstalk, propagation delay, etc. It is well known that by lowering the effective dielectric constant of the cable by including air in the dielectric, the signal speed can be increased.

Providing porosity in a dielectric suitable for cables is known. Foamed polyethylene insulative materials are known from U.S. Pat. No. 3,529,340, where the foam coated conductors were placed in a sheath which is shrunk onto the foam covered conductors. Another patent is U.S. Pat. No. 4,680,423, disclosing a foam-type insulation such as polypropylene or polyethylene surrounding conductors, which foam covered conductors are then embedded within an insulating material such as polyvinyl chloride. The foamed insulation is said to contain a large percentage of air trapped within the material. The insulating material is used to hold the conductors in a parallel configuration and provides strength to the cable when subjected to compression.

Another patent describing a foamed insulative material for conductors includes U.S. Pat. No. 5,110,998, issued May 5, 1992 describing an ultramicrocellular foamed polymer structure formed from suitable polymers including the class of synthetic, crystalline and crystallizable, organic polymers, e.g. polyhydrocarbons such as linear polyethylene, polypropylene, stereoregular polypropylenes or polystyrene, polyethers such as polyvinylidene fluoride, polyamides both aliphatic and aromatic, and the list goes on, but concludes the polymers should have a softening point of at least about 40° C. This foamed material, because of the high degree of orientation of the closed polyhedral cells, contributes to the strength of the structures.

Further, W. L. Gore & Associates, Inc. sells cable made with "Gortex" dielectric films, a porous polytetrafluoroethylene (PTFE). Polytetrafluoroethylene is not a conventional thermoplastic and is not easily processed and is costly. Various patents have been assigned to W. L. Gore & Associates, Inc. of Newark, Delaware including U.S. Pat. Nos. 3,953,566 and 4,187,390 relating to the process for making a porous polytetrafluoroethylene polymer; 4,443,657 relates to the manufacture of a ribbon cable using two layers of polytetrafluoroethylene (PTFE) as insulation, and 4,866,212 relating to a coaxial electric cable formed of an expanded polytetrafluoroethylene.

High speed cables of the prior art generally utilize expanded PTFE dielectrics such as those sold by W. L. Gore & Associates, Inc. or foamed perfluoro polymers. Such cable structures have lower crush resistance as compared to solid dielectrics. This lower crush resistance results in reduced transmission line performance as a result of damage caused by normal routing or handling of cables made from these conventional dielectrics.

The lack of crush resistance of known dielectrics used for cable insulation, which contain large percentages of air voids, has long been a problem for use as high speed dielectrics. In U.S. Pat. No. 4,730,088 assigned to Junkosha Co., LTD., Japan, the solution for improving crush resistance was reinforcing expanded polytetrafluoroethylene (PTFE) by the use of a laser beam or a hot metal rod. The piercing of the soft insulation by the beam or rod caused a unique phenomenon to occur to the porous PTFE called sintering. In this case, the sintering causes the soft dielectric to form a solid skin of PTFE on the inside wall of the created hole. Since sintered PTFE has many times the structural strength of the unsintered porous dielectric, the cylinders so created function like beams to resist crushing forces. An alternate method disclosed, used heated rolls to put grooves in the surface of the insulation. The sole purpose of both methods is to increase the crush resistance of the insulation. Both solutions suffer from the creation of discontinuities in the dielectric which add to signal speed variation as the electrical fields encounter these discontinuities.

U.S. Pat. No. 4,443,657, assigned to W.L. Gore and Associates, Inc., demonstrates a means of bonding sheets of PTFE using a sintering process. The softness of the unsintered core dielectric forces the inventor to place a solid layer of insulation over the top of the unsintered core resulting in significant reductions in electrical performance of the finished cable due to the solid dielectric.

Because of the very high processing temperatures of traditional PTFE cables, cables made in ribbon format with polytetrafluoroetylene generally have silver plated or nickel plated conductors to avoid the oxidation of the conductors during processing. Use of either of these plated conductors causes significant cost increase. In addition, if nickel is used, difficulty in soldering to the conductors is encountered.

It should be noted that lamination and fusion of thermoplastic insulations to make ribbon cables has been taught in the prior art such as U.S. Pat. No. 3,523,844 assigned to David J. Crimmins, et. al. and U.S. Pat. No. 2,952,728 assigned to Kyohei Yokose, et. al. The Crimmins patent teaches lamination of solid dielectrics around variably spaced wires. This method will not work with air filled dielectrics without collapsing the air filled structure. Similarly, the Yokose patent teaches lamination of solid dielectrics around conductors. However, the tool or roller design employed will cause excessive melting and destruction of the fibril structure of the material in the present invention. Both of the methods employed in the prior art would not work with the materials presented herein. The process and materials of the present invention teach lamination without significant destruction or collapse of the air filled structure adjacent the conductors.

The prior art demonstrates that many attempts have been made to provide electrical cables with lower dielectric constant and/or fixed shield-wire spacing to improve electrical characteristics. The prior art cables, even the foamed materials, sacrifice durability and crush resistance to achieve lower dielectric constant and faster propagation velocities. U.S. Pat. No. 5,110,998, describes a foamed structure for use as an insulative material for individual conductors smaller than 1.27 mm and annular insulation thickness less than 0.51 mm. The insulative material is flash spun over a moving wire in air at ambient temperature and pressure or by an extrusion spinning method. The crush resistance of the material is described in column 3 lines 64 to column 4 line 9. The recovery rate is not considered sufficient to provide good electrical properties to signal wire and the material is not suitable for making ribbon cable.

The present invention provides a product having improved crush resistance over unsintered expanded polytetrafluoroethylene without the time consuming and expensive process of forming sintered cylinders or grooves in the dielectric as disclosed in U.S. Pat. No. 4,730,088 assigned to Junkosha Co., LTD, Japan.

The product of the present invention in addition to having the improved electrical properties at substantially reduced cost and with improved crush resistance, does not have the dielectric discontinuities associated with the formation of sintered shapes as with prior art. The process used to form this product also can be accomplished at substantially reduced temperatures permitting conductors to be used with or without plating which provides additional cost reduction. The unique crush resistant properties of the subject product result since the polymers employed to make the insulation do not have the uncharacteristic changes caused by sintering as with PTFE but rather have the improved properties immediately upon cooling thus eliminating the costly and time consuming sintering processes.

Prior expanded materials, have also lacked this characteristic, in part due to the necessity to employ polymer structures which are inherently soft or weak in their structural integrity.

The prior art demonstrates that many attempts have been made to provide electrical cables with lower dielectric constant to improve electrical characteristics and to provide crush resistance to high speed dielectrics.

SUMMARY OF THE INVENTION

The present invention relates to a cable for transmitting electromagnetic signals which cable comprises a conductor, and a layer of thermally stable, crush resistant, fibril microporous heat sealable thermoplastic crystallizable polymer dielectric surrounding the conductor, said dielectric having a void volume in excess of 70%, a propagation velocity of the insulated conductor greater than 85% the propagation velocity in air and the recovery rate after being under a 500 gram weight for 10 minutes greater than 92% of the initial thickness. It is desirable to have the material have a density less than 0.3 gm/cc. In one embodiment, a plurality of conductors are positioned in equally spaced continuous relationship and a layer of microporous fibril thermally stable, crush resistant, heat sealable thermoplastic dielectric. An example of a suitable thermoplastic material is a crystallizable polymer, such as polypropylene.

The ribbon cable having a plurality of conductors can be prepared by a hot lamination process of at least a pair of opposed microporous thermoplastic sheets each prepared as described in U.S. Pat. No. 4,539,256 or 4,726,989. The sheet is a thermoplastic polymer, for example a polyolefin having dielectric characteristics and crush resistance of polypropylene. A laminating process embeds spaced wires within the layers of the thermoplastic sheet, yet does not collapse the interstices or spaces in the sheets surrounding the conductor which would dislodge any included air. A ribbon cable can also be manufactured by using an adhesive coating on such a sheet or mat during the lamination process.

The dielectric having been biaxially expanded contains nodes or nodules with fine diameter fibrils connecting the nodules in three dimensions. Since on a microscopic basis, the insulation is nonuniform in density, the rate of heat transfer through the polymer is controlled by the cross sectional area of the fibrils. The application of heat and pressure at the bond zones between the wires has virtually no impact on the dielectric around the conductor as the fibrils are small enough to significantly reduce the rate of heat transfer between the nodules and therefore through the entire dielectric structure. This is an important characteristic since this phenomena prevents the bonding between conductors from causing collapse of the cell structure around the conductors.

DESCRIPTION OF THE DRAWING

The present invention will be further described with reference to the accompanying drawing wherein.

DETAILED DESCRIPTION OF SEVERAL PRESENTLY PREFERRED EMBODIMENTS

Figure 1:
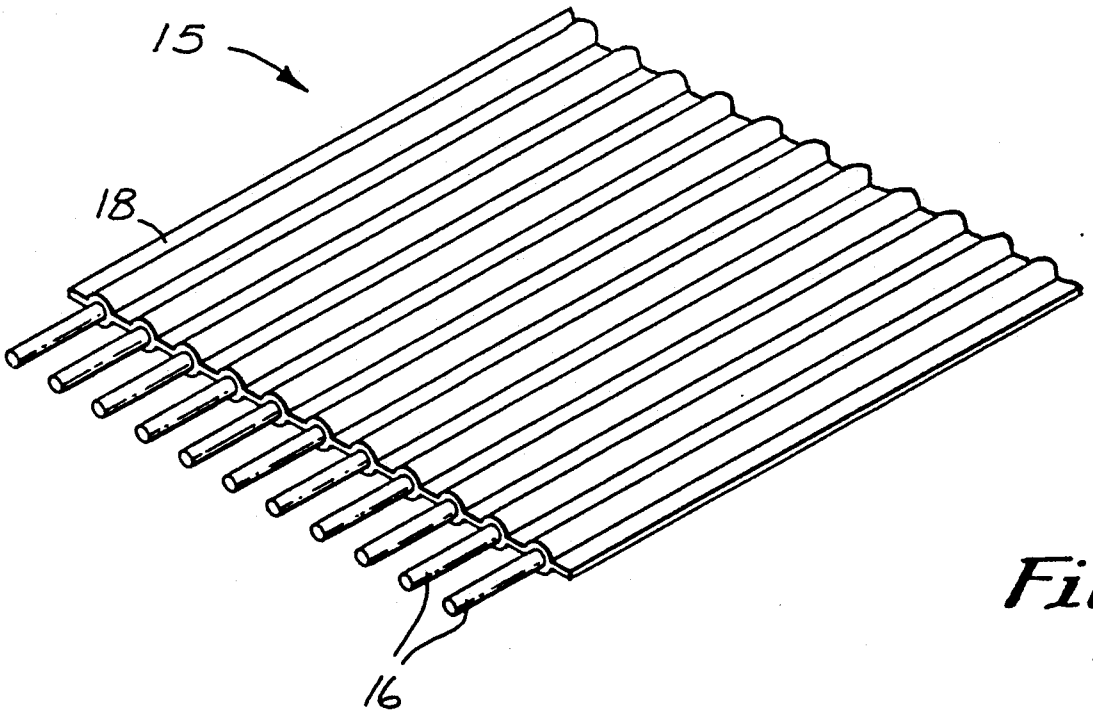
FIG. 1 is a perspective view of a section of cable constructed according to the present invention.

The present invention provides a novel cable structure having a low dielectric constant, i.e., below the dielectric constant of solid polytetrafluoroethylene and utilizing a thermoplastic material having improved characteristics and economics of processing. The product so disclosed also has improved crush resistance over unsintered expanded polytetrafluoroethylene. The process used to form this product also can be accomplished at substantially reduced temperatures permitting conductors to be used with or without plating which provides additional cost reduction. The unique crush resistant properties of the subject product result since the polymers employed to make the insulation do not have the uncharacteristic changes caused by sintering as with PTFE but rather have the improved properties immediately upon cooling thus eliminating the costly and time consuming sintering processes. The following detailed description refers to the drawing.

Referring now to FIG. 1 there is illustrated a cable 15 comprising a plurality of spaced flexible conductors 16 constructed of any electrically conductive material commonly used in the electronic industry. The cable 15 further comprises an insulator 18 disposed about the conductors 16 to maintain the same in spaced relationship and surrounding the conductors 16. The insulator is preferably a microporous dielectric thermoplastic polymer, e.g. polypropylene formed in continuous sheets or mats and placed on the conductors and bonded together to seal the conductors in spaced relationship.

A preferred microporous dielectric is the fibril microporous material described in U.S. Pat. Nos. 4,539,256 and 4,726,989, and assigned to Minnesota Mining and Manufacturing Company, of St. Paul, Minnesota. The disclosures of U.S. Pat. Nos. 4,539,256 and 4,726,989 are incorporated herein by reference. The '256 patent above referred to describes a method of making a microporous fibril sheet material comprising the steps of melt blending crystallizable thermoplastic polymer with a compound which is miscible with the thermoplastic polymer at the melting temperature of the polymer but phase separates on cooling at or below the crystallization temperature of the polymer, forming a shaped article of the melt blend. During the blending an antioxidant is added to improve the high temperature oxidation resistance of the fibril material. The cooling of the shaped article to a temperature at which the polymer crystallizes will cause phase separation to occur between the thermoplastic polymer and the compound to provide an article comprising a first phase comprising particles of crystallized thermoplastic polymer in a second phase of the compound. Orienting the article in at least one direction will provide a network of interconnected micropores throughout. The microporous article comprises about 30 to 80 parts by weight crystallizable thermoplastic polymer and about 70 to 20 parts by weight of compound. The oriented article has a microporous structure characterized by a multiplicity of spaced randomly dispersed, equiaxed, non-uniform shaped nodes, nodules or particles of the thermoplastic polymer which are coated with the compound. Adjacent thermoplastic particles within the article are connected to each other by a plurality of fibrils consisting of the thermoplastic polymer. The fibrils radiate in three dimensions from each particle. The amount of compound is reduced by removal from the sheet article, e.g., by solvent extraction. Patent No. '989 relates to a microporous material as described in patent No. '256, but incorporating a nucleating agent to permit greater quantities of additive compound to be used and providing a higher degree of porosity in the material.

A specific example of the microporous material as used in the present invention is as follows:

Polypropylene (Profax TM 6723, available from Himont Incorporated), 0.25 weight percent (based on the polymer) dibenzylidene sorbitol nucleating agent (Millad TM 905, available from Milliken Chemical), and 4.6 weight % of Irganox TM 1010 from Ciba Geigy, a substituted phenol antioxidant (based on the weight of polymer used), and mineral oil (Amoco TM White Mineral Oil #31 USP Grade available from Amoco Oil Co., at a weight ratio of polypropylene to mineral oil of 35:65, were mixed in a Berstorff TM 40 mm twin screw extruder operated at a decreasing temperature profile of 266° C. to 166° C., the mixture was extruded, at a total throughput rate of 20.5 kg/hr., from a 30.5 cm×0.7 mm slit gap sheeting die onto a chill roll casting wheel. The wheel was maintained at 65.6° C. and the extruded material solid-liquid phase separated. A continuous sheet of this material was collected at 1.98 meter/min. and passed through a 1,1-Dichloro-2,2-Trifluoro Ethane (duPont TM Vertrel 423) bath to remove approximately 60% of the initial mineral oil. The resultant washed film was lengthwise stretched 125% at 110° C. It was then transversely stretched 125% at 121° C. and heat set at 149° C. The finished porous film, at a thickness of 0.024 cm, was tested in a 113° C. convection oven to determine its resistance to oxidative degradation. After 168 hours at this temperature, the material showed no visible degradation including cracking when bent 180° around a 3.2 mm diameter mandrel.

A second example of the microporous material is as follows:

Polymethylpentene (DX-845), available from Mitsui Petrochemical Industries, Ltd., 0.25 weight percent (based on the polymer) dibenzylidene sorbitol nucleating agent (Millad TM 3905, available from Milliken Chemical), and 4.6 weight % of Irganox TM 1010 from Ciba Geigy, a substituted phenol antioxidant (based on the weight of polymer used), and mineral oil (Amoco TM White Mineral Oil #31 USP Grade available from Amoco Oil Co., at a weight ratio of polypropylene to mineral oil of 35:65, were mixed in a Berstorff TM 25 mm twin screw extruder operated at a decreasing temperature profile of 271° C. to 222° C., the mixture was extruded, at a total throughput rate of 4.5 kg/hr., from a 35.6 cm×0.6 mm slit gap sheeting die onto a chill roll casting wheel. The wheel was maintained at 71° C. and the extruded material solid-liquid phase separated. A continuous sheet of this material was collected at 0.78 meter/min. and passed through a 1,1-Dichloro2,2-Trifluoro Ethane (duPont TM Vertrel 423) bath to remove approximately 60% of the initial mineral oil. The resultant washed film was lengthwise stretched 200% at 121° C. It was then transversely stretched 200% at 121° C. and heat set at 121° C.

The article of the above described examples has a microporous structure characterized by a multiplicity of spaced, i.e., separated from one another, randomly dispersed, nonuniform shaped, equiaxed particles of thermoplastic polymer coated with the compound and connected by fibrils. (Equiaxed means having approximately equal dimensions in all directions.) The term "thermoplastic polymer" is not intended to include polymers characterized by including solely perfluoro monomeric units, e.g., perfluoroethylene units, such as polytetrafluoroethylene (PTFE) which under extreme conditions, may be thermoplastic and rendered melt processable. It will be understood that, when referring to the thermoplastic polymer as being "crystallized," this means that it is at least partially crystalline. Crystalline structure in melt processed thermoplastic polymers is well understood by those skilled in the art.

Figure 2:
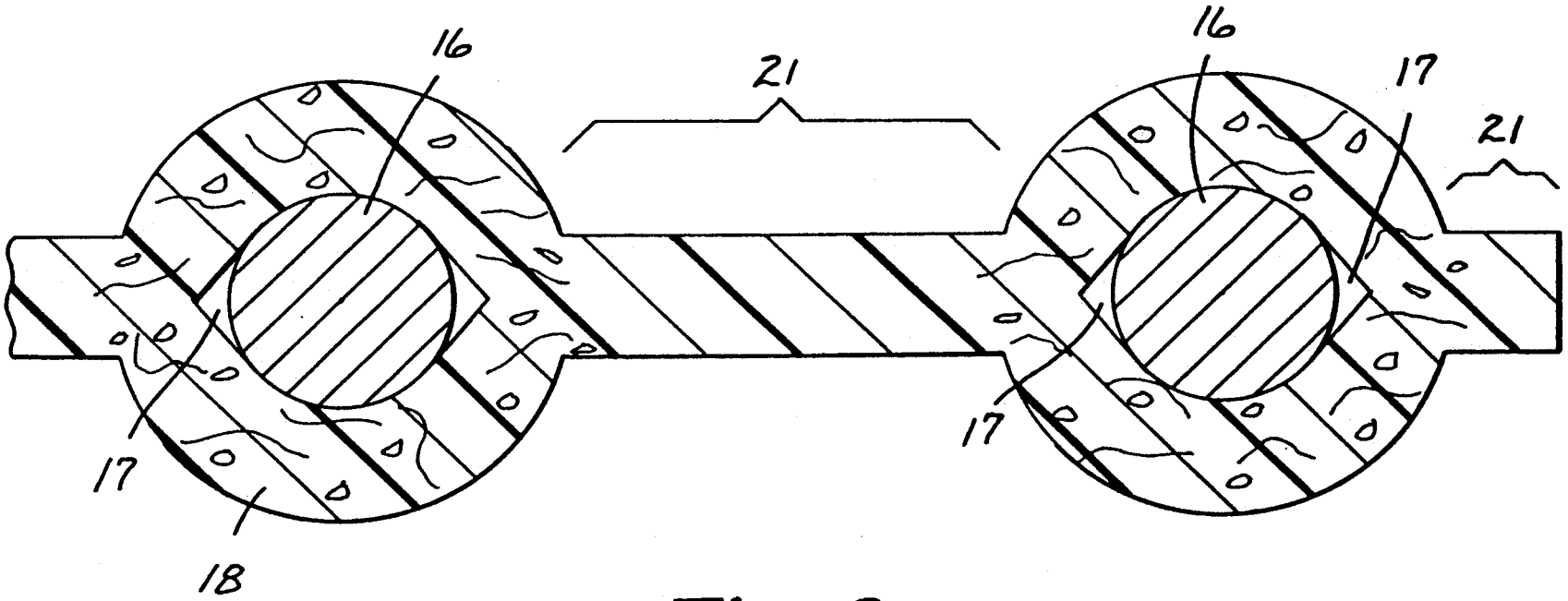
FIG. 2 is a partial cross-sectional view of the cable of FIG. 1.

FIG. 2 illustrates a transverse cross-section of the cable of FIG. 1 taken in a position to illustrate a plurality of conductors 16 arranged in a row in spaced parallel relationship and surrounded by the dielectric layer 18.

In reviewing this figure it is evident that the layers of the insulative microporous fibril sheet 18 are bonded in an area 21 between the conductors 16 and outboard of the conductors on the edge of the cable. The insulative material of the bonded sheets is reduced in thickness in the bonding area 21. This bonding of the sheets of dielectric material defines a spacing between the conductors and positions the fibril dielectric insulator 18 about each conductor 16 in the cable. There is a noticeable eye formed by the voids 17 remaining adjacent each side of the adjacent conductors 16. This eye can be reduced in dimension by appropriate laminating tool designs.

In one embodiment, the bonding in the area 21 is accomplished by heat fusing of two or more webs or sheets of the thermoplastic polymer together in the area 21 on each side of the conductors 16.

Figure 3:
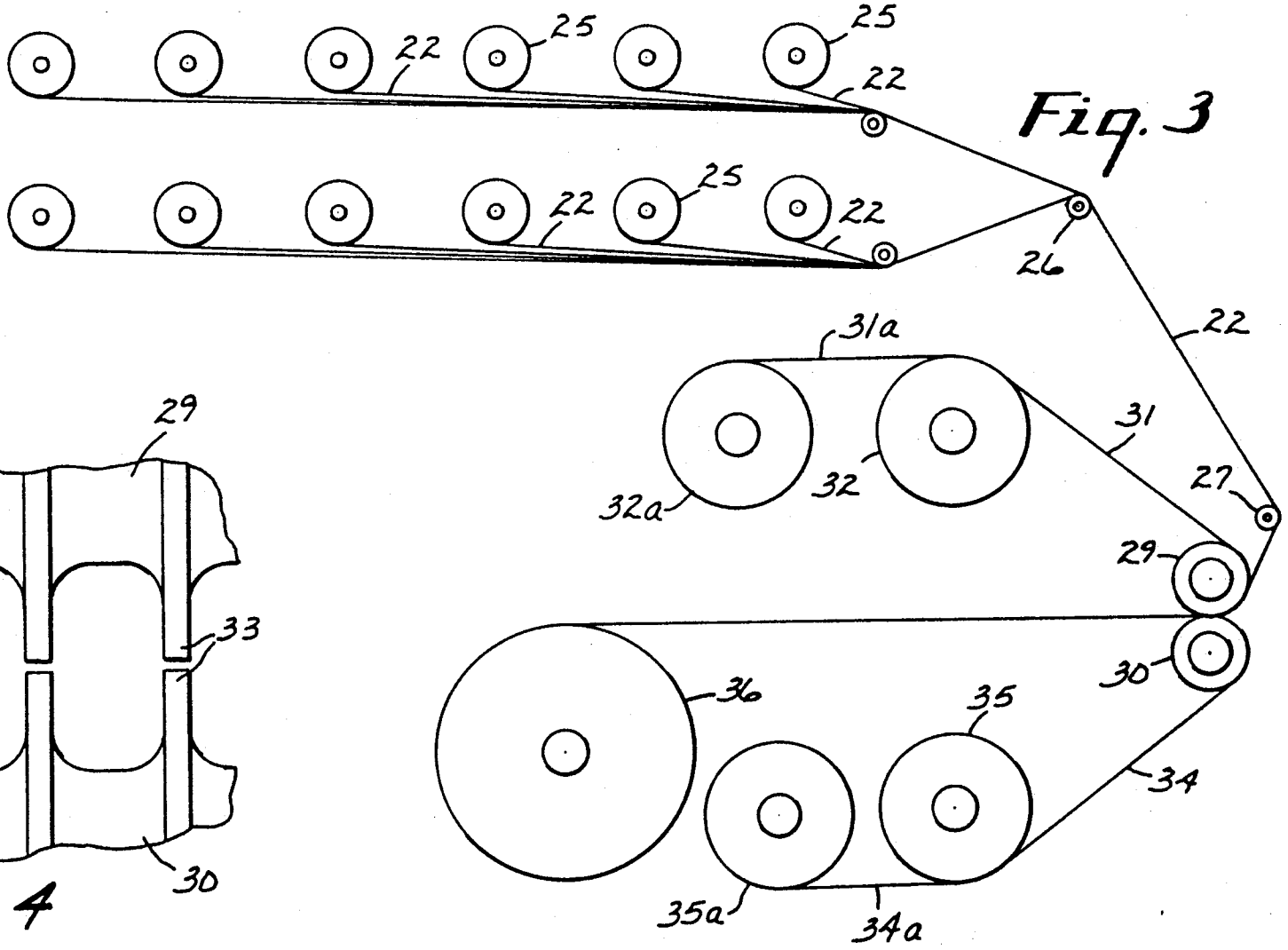
FIG. 3 is a schematic view of the manufacturing process for cable of FIG. 1.

Referring to FIG. 3, cable 15 is formed by dispensing a plurality of conductive fibers or wires 22 from supply reels 25 over guide rolls 26 and 27 and between an upper tooling roller 29 and a lower tooling roller 30. Around the upper tooling roller 29 is guided continuous webs 31 and/or 31*a* of microporous thermoplastic polymer drawn from supply rolls 32 and/or 32*a*. One or more continuous webs 34 and/or 34*a* of microporous thermoplastic polymer is drawn from rolls 35 and/or 35*a* and is guided around the lower tooling roller 30. The conductive fibers 22 which form the conductors 16 are thus positioned between the webs 31, 31*a* and 34, 34*a* and the resulting laminate or cable is wound upon a reel 36.

Figure 4:
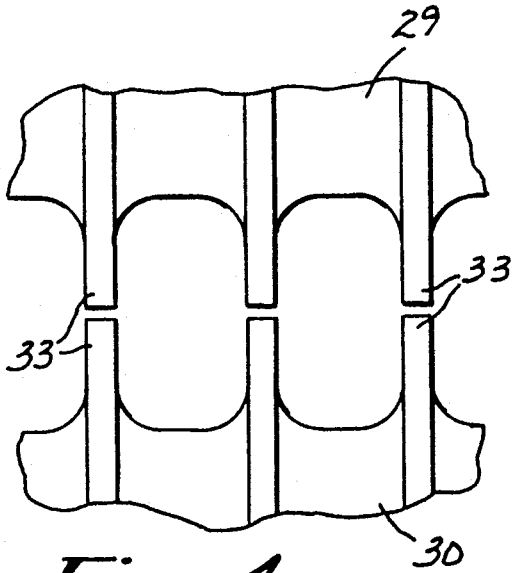
FIG. 4 is a fragmentary detail side view of the tooling rolls of the manufacturing equipment.

Referring to FIG. 4, the tooling rolls 29 and 30 are held in an adjustable spaced relationship to each other thereby allowing adjustment of the gap between the rolls and the tooling rolls 29 and 30 are formed with thin spaced disc-like portions 33 separated to allow the fibers 22 and the webs (31, 31A, 34, 34A) to pass between the discs 33, but the discs 33 are so close that the pressure and temperature of the rolls bond the webs between the discs in the areas 21 which generally have a dimension corresponding to the axial dimension of the discs.

Bonding the webs between the conductors 16 without experiencing a collapse of the web structure surrounding the conductor 16 has been experienced by controlling the line speed through the laminator rolls 29 and 30 and controlling the temperature of the rolls 29 and 30. Typical conditions for polypropylene material are temperatures of 140° C. and four (4) meters per minute.

Figure 5:
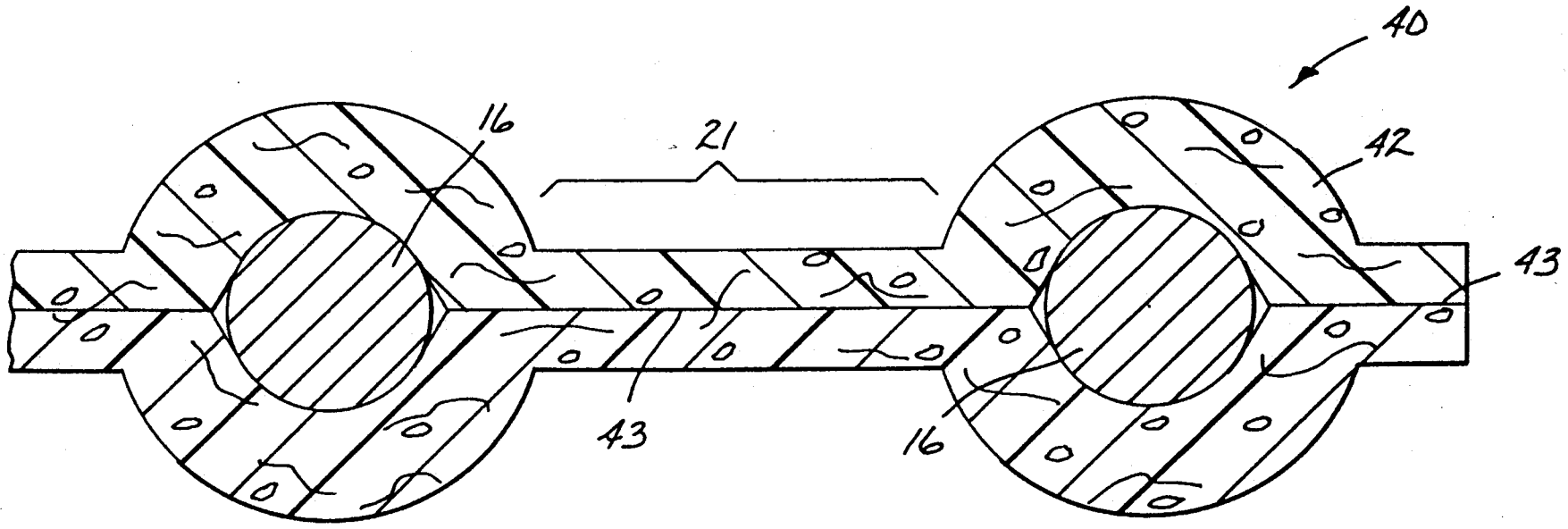
FIG. 5 is a cross-sectional view of a cable showing a second embodiment of the present invention.

A second embodiment of a cable 40 is illustrated in FIG. 5. In this embodiment, the webs 42, corresponding to webs 31 and 34 are coated with an adhesive 43 which serves to bond the webs together in the areas 21 between the conductors 16. The bonding process can still cause a crushing of the microporous webs in the bonding areas 21 but the webs 42 are not subjected to heat if a pressure sensitive adhesive is used. If a hot melt adhesive is used, then heat will be applied. It is preferred to strip coat or zone coat the webs 42 so the adhesive is only present in the bonding areas 21.

Figure 6:
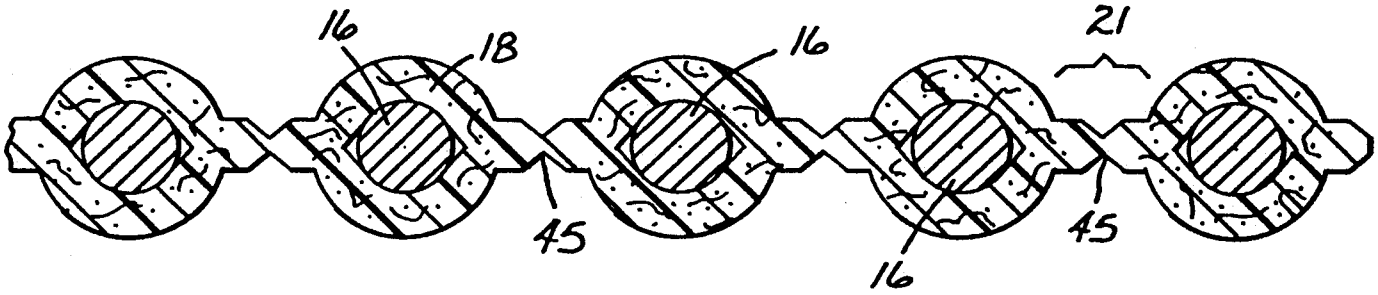
FIG. 6 is a cross-sectional view of a cable according to FIG. 1, which has been processed to form discrete wires.
Figure 7:
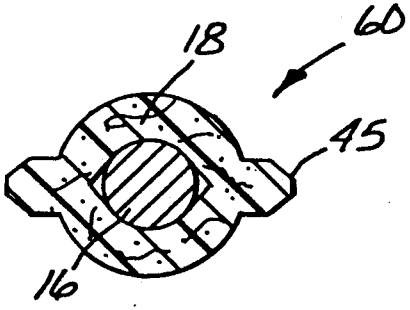
FIG. 7 is a cross-sectional view of a discrete wire according to the present invention.

FIG. 6 illustrates a cable constructed according to the cable of FIG. 2 but this figure illustrates the forming of discrete wires from a ribbon cable forming apparatus according to FIG. 3. In this embodiment the dielectric material in the bonded areas 21 has been further reduced, as at 45, by the tooling rolls to an extent that the thermoplastic material is weakened and that the conductors 16 and the surrounding dielectric sheet material 18 are readily separated from the adjacent conductor 16 to form discrete insulated wires 60 as illustrated in FIG. 7.

By example, samples of the basic ribbon cable 15 have been made using a polypropylene porous fibril material and 30 gauge wire, spaced 1.270 mm (0.050 inch), which yielded the results as follows in Table 1:

TABLE 1

| Insulation Thickness (mm) | Propagation Delay (nsec/m) | % Velocity in Air | Imp ohm | Cap pf/m |
|---|---|---|---|---|
| 0.254 each side | 3.64 | 92.0 | 184 | 19.7 |

In the example above, the electrical data indicates that the sample has a signal velocity equal to 92% of that achieved with an air dielectric. Void volumes of 70% and above are easily obtainable. In the above example, the density of the dielectric is 0.18 gm/cc.

TABLE 2

TYPICAL PROPAGATION PROPERTIES OF UNSHIELDED RIBBON CABLES

| Insulation Type | % Velocity in Air | Propagation Delay Nanosec/M | Effective Dielectric Constant |
|---|---|---|---|
| *PVC | 72.6 | 4.59 | 1.90 |
| *Thermo Plastic Elastomer (TPE) | 74.2 | 4.49 | 1.81 |
| PTFE (Solid) | 82.0 | 4.07 | 1.49 |
| Expanded PTFE or Foamed FEP Films | 87.7 | 3.81 | 1.30 |
| *Microporous Polypropylene Film of the present invention | 91.6 | 3.64 | 1.19 |

*All tests performed in unbalanced (single ended) configuration.

Table 2 shows a comparison of a sample of the improved cable with available data on other cables and the cable of the present invention is as good as the expanded polytetrafluoroethylene and the embodiment described offers many advantages over the prior known cable structures.

For use in the manufacture of wires and cables as disclosed herein, the microporous thermoplastic material should preferably have a density of between 0.82 gm/cc and 0.15 gm/cc and the spacing of the conductors and thicknesses of the webs are selected to provide the desired electrical characteristics. The conductor sizes can vary also according to the electrical characteristics that are desired.

The following data demonstrates the improved crush resistance of the microporous thermoplastic insulation disclosed in the present invention.

To test for crush resistance, insulation samples were taken from both a Gore 50 Ohm coaxial cable, available from W. L. Gore & Associates, Inc., one sample of single thickness and one of double web thickness; from three larger sheets of microporous polypropylene film, one with 12% compound, one 17% and the last 26%; two sheets of polyethylene, one 0.104 mm thick and 0.32 g/cc density and the other 0.142 mm thick and 0.23 g/cc density; and a sheet of polymethylpentene. These films had similar dimensions such that physical characteristics could be compared. All measurements and tests were done at room temperature. The unloaded thickness and width of each sample was measured and recorded. A sample was then placed under a bench micrometer anvil of 9.98 mm diameter. When the anvil was lowered onto the sample, a 500 gram weight was applied to the sample by the anvil of the micrometer which corresponds to approximately 63.8 kPa pressure. The sample was left in this loaded condition for ten (10) minutes and then measured. The weight was removed. The thickness was again measured after an interval of ten (10) minutes. The difference between initial and loaded thickness is the amount of compression under a known load. Comparing the final thickness measurement with the initial unloaded measurement provides a measurement of the insulation's ability to recover from a known load. Table 3 indicates the test results.

TABLE 3

| Cable Description | Initial Thickness w/o weight (mm) A | After 10 min. w/weight (mm) B | After 10 min. w/o weight (mm) C | % Reduction (A-B)/A | % Reduction (A-C)/A | % Recovery 100-[(A-C)/A] |
|---|---|---|---|---|---|---|
| 931-3A (12% oil) Polypropylene | 0.268 | 0.249 | 0.260 | 7.11 | 2.84 | 97.16 |
| 931-1B (17% oil) Polypropylene | 0.258 | 0.234 | 0.249 | 9.36 | 3.45 | 96.55 |
| 931-2B (26% oil) Polypropylene | 0.258 | 0.231 | 0.248 | 10.34 | 3.94 | 96.06 |
| Gore 50 ohm 5000-5 Single thickness | 0.058 | 0.050 | 0.053 | 13.91 | 9.57 | 90.43 |
| Gore 50 ohm 5000-5 Double thickness | 0.124 | 0.109 | 0.114 | 12.24 | 8.57 | 91.43 |
| 479-21A Polyethylene | 0.104 | 0.084 | 0.090 | 19.02 | 13.41 | 86.59 |
| 839-7 Polyethylene | 0.142 | 0.108 | 0.121 | 24.11 | 14.64 | 85.36 |
| 699-3 TPX Polymethylpentene | 0.160 | 0.145 | 0.152 | 9.52 | 4.76 | 95.24 |

(A-B)/A reflects the overall reduction in thickness during the crush part of test.
(A-C)/A reflects the recovery or "spring back" of the material.
% Recovery refers to the percent of the initial thickness remaining after the test.

In the above test the microporous polypropylene material and the polymethylpentene material recovered to an amount greater than 92% of the original thickness. In fact the preferred range is 95% or greater. The PTFE material from the Gore cable recovered to only between 90 and 91.43% of the original thickness. This improved crush resistance affords lower bend radii and improved handling and routing durability. The polyethylene material recovered less than 90% of its original thickness and lacked the desired crush resistance.

These results show that the polypropylene and polymethylpentene materials provides a structure which exhibits a high degree of crush resistance improvement over PTFE. The reasons are believed to be the increased stiffness of the material over polyethylene and PTFE, in that the Young's Modulus is greater for polypropylene and polymethylpentene (TPX). The above table conclusively shows the improved crush resistance between these two polyolefins and also shows improved resiliency, defined as the ability to return to original shape upon the removal of stress.

Table 4 below shows the results of an additional test for crush resistance, using similar Gore material samples and the polypropylene material with 17% oil. All measurements and tests were done at room temperature. The unloaded thickness and width of each sample was measured and recorded. A sample was then placed under a bench micrometer anvil of 9.98 mm diameter. When the anvil was lowered onto the sample, a 1500 gram weight was applied to the sample by the anvil of the micrometer which corresponds to approximately 191.55 Kpa pressure. The sample was left in this loaded condition for ten (10) minutes and then measured. The weight was then removed. The thickness was again measured after a ten (10) minute interval. The difference between initial and loaded thickness is the amount of compression under a known load. Comparing the final thickness measurement with the loaded measurement provides a measurement of the insulation's ability to recover from a known load. The data is recorded in Table 4.

TABLE 4

| Cable Description | Initial Thickness w/o weight (mm) A | After 10 min. w/weight (mm) B | After 10 min. w/o weight (mm) C | % Reduction (A-B)/A | % Reduction (A-C)/A | % Recovery 100-[(A-C)/A] |
|---|---|---|---|---|---|---|
| 931-1B (17% oil) Polypropylene | 0.259 | 0.220 | 0.249 | 15.20 | 3.92 | 96.08 |
| Gore 50 ohm 5000-5 Single Thickness | 0.060 | 0.042 | 0.046 | 29.79 | 22.55 | 77.45 |
| Gore 50 ohm 5000-5 Double thickness | 0.130 | 0.105 | 0.114 | 18.63 | 11.76 | 88.24 |

(A-B)/A reflects the overall reduction in thickness during the crush part of test.
(A-C)/A reflects the recovery or "spring back" of the material.
% Recovery refers to the percent of the initial thickness remaining after the test.

The success of this process and product is in the careful control of the materials used in the extrusile composition. Resistance to elevated temperatures, oxidative degradation of high internal surface porous film, requires that minimum levels of specific antioxidants, (preferably a hindered phenol) be present in the finished film. The high levels of antioxidant, 10 to 20 times the levels normally used, is necessary because the solvent washing operation can remove up to 80% of the antioxidant with the oil. When the cast polypropylene/oil film is solvent washed to a specific minimum residual oil level of 15% to 25% by weight of the finished film, the added antioxidant assures that adequate antioxidant will remain in the oriented finished film. The amount of mineral oil left in the film, however increases its heat transfer. The higher heat transfer will cause some collapse of the fibril structure during lamination in areas adjacent the bond area, thus increasing the insulation dielectric constant. Too little oil will cause an excessive amount of antioxidant to be removed causing the product to fail after a relatively short interval at elevated temperatures. Therefore, the level of oil retained to achieve the proper balance, is preferably between 15% and 25% by weight of the finished film.

A ribbon cable could also be made with the present invention by using adhesive to bond the top and bottom insulation layers in the bond zones without the use of high bonding temperatures but this is not the preferred method since the adhesive would have a higher dielectric constant which would reduce the cable electrical performance.

Having described the present invention with reference to several embodiments of the invention, it will be appreciated that other modifications may be made without departing from the spirit or scope of the invention as defined in the appended claims.

We claim:

1. A cable for transmitting electromagnetic signals comprising:

a conductor, and a layer of thermally stable, crush resistant, fibril microporous heat sealable thermoplastic crystallizable polymer dielectric surrounding said conductor, said dielectric having a void volume in excess of 70%, a propagation velocity of the insulated conductor greater than 85% the propagation velocity in air and the recovery rate after being under a 500 gram weight for 10 minutes greater than 92% of the initial thickness.

2. A cable according to claim 1 wherein the dielectric has a density of less than 0.3 gm/cc.

3. A cable according to claim 1 wherein said dielectric is polypropylene.

4. A cable according to claim 1 wherein said dielectric is polymethylpentene.

5. A mass terminable cable for transmitting electromagnetic signals comprising:

a plurality of conductors disposed in spaced side-by-side parallel relationship to define a row of conductors, which row has opposite sides and ends, at least one layer of thermally stable, crush resistant, fibril microporous thermoplastic material disposed on opposite sides of said row of conductors, with the layers on opposite sides bonded together between adjacent conductors and along the ends of the row, said thermoplastic material having a void volume in excess of 70%, a propagation velocity of the insulated conductor greater than 85% the speed in air and a recovery rate after being under a 500 gram weight for 10 minutes is greater than 92% of the initial thickness.

6. A cable according to claim 5 wherein the bonding is a heat sealing of the layers of thermoplastic material together between the adjacent conductors.

7. A cable according to claim 5 wherein the layers of material are adhesively bonded together between the adjacent conductors.

8. A cable according to claim 5 wherein said thermoplastic material is a crystallizable polyolefin.

9. A cable according to claim 5 wherein said crystallizable polyolefin is polypropylene.

10. A cable according to claim 5 wherein said crystallizable polyolefin is polymethylpentene.

11. A process for making a cable comprising the steps of placing a plurality of conductors in parallel close spaced relationship to form a row of conductors in transverse section, positioning a web of thermally stable, crush resistant, fibril microporous dielectric thermoplastic polymer having a void volume in excess of 70%, with a propagation velocity of the insulated conductor greater than 85% the speed in air and the recovery rate after being under a 500 gram weight for 10 minutes of greater than 92% of the initial thickness, against each side of said row of conductors, and bonding the webs together in the area between the conductors.

12. A cable according to claim 1 wherein said dielectric comprises polypropylene, about 0.25 weight percent of dibenzylidene sorbitol nucleating agent, and about 4.6 weight % of a substituted phenol antioxidant (based on the weight of polymer used), and mineral oil at a weight ratio of polypropylene to mineral oil of between 30:70 and 80:20.

13. A cable according to claim 1 wherein said dielectric comprises polymethylpentene, about 0.25 weight percent (based on the polymer) dibenzylidene sorbitol nucleating agent, about 4.6 weight % of a substituted phenol antioxidant (based on the weight of polymer used), and mineral oil at a weight ratio of polymethylpentene to mineral oil of 30:70 and 80:20.

14. A cable according to claim 1 wherein said dielectric comprises microporous material comprising about 15 to about 80 parts by weight of crystallizable thermoplastic polymer, about 0.25 weight percent (based on the polymer) of dibenzylidene sorbitol nucleating agent, and 4.6 weight % of a substituted phenol antioxidant (based on the weight of polymer used), and mineral oil at an initial weight ratio of crystallizable polymer to mineral oil of 30:70 and 80:20, with the oil reduced to a level of 15 to 25%.

15. A process according to claim 11 wherein said bonding step comprises advancing said conductors and said webs of polymer between heated rolls spaced to crush the webs in areas between the conductors and to thermally bond the webs in said areas.

16. A process according to claim 11 wherein at least one of said webs of polymer is coated with an adhesive on the side facing the conductors, and pressing the opposed surfaces of said webs in contact with one another on each side of the conductors to bond the webs together.

17. A process according to claim 11 wherein said polymer comprises about 15 to about 80 parts by weight of crystallizable thermoplastic polymer, about 0.25 weight percent (based on the polymer) of dibenzylidene sorbitol nucleating agent, and 4.6 weight % of a substituted phenol antioxidant (based on the weight of polymer used), and mineral oil at an initial weight ratio of crystallizable polymer to mineral oil of 30:70 and 80:20, with the oil reduced to a level of 15 to 25%.

* * * * *

UNITED STATES PATENT AND TRADEMARK OFFICE

CERTIFICATE OF CORRECTION

PATENT NO. : 5,286,924

DATED : Feb. 15, 1994

INVENTOR(S) : Harry A. Loder, et al

It is certified that error appears in the above-indentified patent and that said Letters Patent is hereby corrected as shown below:

Column 5, Line 51, "lad TM 905" should read -- lad TM 3905 --.

Column 9, Line 16, Table 3, Cable Description, "479-21A" should read -- 473-21A --.

Column 12, Line 18, "cent of dibenzylidene" should read -- cent (based on the polymer) of dibenzylidene --.

Signed and Sealed this

Fifth Day of December, 1995

*Attest:*

Bruce Lehman

BRUCE LEHMAN

*Attesting Officer*

*Commissioner of Patents and Trademarks*